US006685429B2

(12) United States Patent
Webster

(10) Patent No.: US 6,685,429 B2
(45) Date of Patent: Feb. 3, 2004

(54) PRESTRESSING OF COMPONENTS

(75) Inventor: John R Webster, Derby (GB)

(73) Assignee: Rolls-Royce plc, London (GB)

( * ) Notice: Subject to any disclaimer, the term of this patent is extended or adjusted under 35 U.S.C. 154(b) by 44 days.

(21) Appl. No.: 09/949,978

(22) Filed: Sep. 12, 2001

(65) Prior Publication Data

US 2002/0037218 A1 Mar. 28, 2002

(30) Foreign Application Priority Data

Sep. 22, 2000 (GB) ..... 0023296

(51) Int. Cl.[7] ..... F01D 9/02

(52) U.S. Cl. ..... 415/191; 416/241 R; 72/76; 29/889.21; 428/610

(58) Field of Search ..... 416/241 R, 223 A; 72/76, 710, 53; 29/889.021; 148/558; 428/610; 415/191

(56) References Cited

U.S. PATENT DOCUMENTS 4,602,142 A * 7/1986 Itoh ..... 219/69 C
5,037,524 A * 8/1991 Juvan ..... 204/307
5,911,891 A * 6/1999 Dulaney et al. ..... 219/121.85
5,932,120 A * 8/1999 Mannava et al. ..... 219/121.85
6,159,619 A * 12/2000 Rockstroh et al. ..... 428/610
6,517,319 B2 * 2/2003 Webster et al. ..... 416/241

FOREIGN PATENT DOCUMENTS

| | | | |
|---|---|---|---|
| DE | 4428791 | P | 2/1996 |
| EP | 0035091 | A | 9/1981 |
| EP | 0829553 | A | 3/1998 |
| EP | 0924306 | A | 6/1999 |
| SU | 1155396 | A | 5/1985 |
| SU | 1615199 | A | 12/1990 |
| SU | 760716 | A | 6/1996 |
| WO | WO 65636 | A | 12/1999 |

* cited by examiner

*Primary Examiner*—Edward K. Look
*Assistant Examiner*—James M McAleenan
(74) *Attorney, Agent, or Firm*—W. Warren Taltavull; Manelli Denison & Selter PLLC

(57) ABSTRACT

A method of prestressing a component (30) includes the use of an electrical discharge or current to produce a plasma (39) within a medium (32) located adjacent the component (30). The plasma generates a shock wave which impacts a surface of the component to produce a region of compressive residual stress within the component.

24 Claims, 4 Drawing Sheets

PRESTRESSING OF COMPONENTS

FIELD OF THE INVENTION

The invention relates to a method of prestressing a component or material and particularly to a method of prestressing an aerofoil, such as an aerofoil section of a gas turbine engine compressor or turbine blade or vane. The invention further relates to a prestressed component and particularly to a prestressed aerofoil, such as an aerofoil section of a gas turbine engine compressor or turbine blade or vane.

BACKGROUND OF THE INVENTION

Gas turbine engine components are susceptible to damage caused by foreign object ingestion and general fatigue. Such damage may result in stress concentrations and cracks which limit the components' lives. This is a particular problem in aerofoil leading and trailing edges in both compressor and turbine blades and vanes. One known solution is to increase the thickness of the aerofoil section in the leading and trailing edges. However, this adds weight and adversely affects the aerodynamic performance of the blade, reducing the efficiency of the engine.

It has also previously been proposed to introduce regions of residual compressive stress into aerofoils, ideally resulting in the entire cross-section of the leading and trailing edges being under compression. By creating such "through thickness compression" whereby the residual stresses in the edges of the aerofoil are purely compressive, the tendency for cracks to grow is severely reduced. The stress field is equalised out in the less critical remainder of the blade.

Prior U.S. Pat. Nos. 5,591,009 and 5,531,570 disclose a fan blade with regions of deep compressive residual stresses imparted by laser shock peening at the leading and trailing edges of the fan blade. The method for producing this fan blade includes the use of multiple radiation pulses from high power pulsed lasers producing shock waves on the surface of a work piece. However the processes disclosed in these prior patents have a number of disadvantages. The magnitude and the penetration depth of the induced stresses is limited, while the process is generally time consuming, costly and restricted to areas which have optical access. Laser shock peening can typically provide a penetration depth of 1 mm.

SUMMARY OF THE INVENTION

According to the invention there is provided a method of prestressing a material, the method including the step of using an electrical discharge or current to produce a pressure pulse in the material or in a medium adjacent the material, the pressure pulse impacting a surface of the material to produce a region of compressive residual stress within the material.

Preferably the electrical discharge or current generates a plasma in the medium. The medium preferably comprises a liquid such as oil or water.

The electrical discharge or current preferably has an energy of at least 35 J and a duration of less than 40 ns.

Preferably the pressure pulse produces an impact pressure of at least 15 GPa on the surface of the material.

The electrical discharge or current may be provided between electrodes. The electrodes may be located between the material and a fixed means for containing or reflecting the pressure pulse.

The electrodes may be located remotely from the surface of the material and the method may include the step of directing the pressure pulse towards the surface of the material. The method may include the step of providing focusing means in the form of a reflector.

The method may include the step of concentrating the pressure pulse as it approaches the surface of the material. The method may include the step of providing concentrating means of a material through which the pressure pulse travels faster than it does in the medium, a sectional area of the concentrating means remote from the surface of the material being greater than a sectional area of the concentrating means adjacent the material.

The pressure pulse may be produced by direct impact of the electrical discharge or current on the surface of the material. The method may include the further step of removing a damaged, sacrificial layer from the surface of the material.

The method may include the step of providing a conducting membrane over a surface of the material and providing the electrical discharge or the current through the conducting membrane.

The material may comprise part of an aerofoil section, which may form part of a compressor or turbine blade or vane. Preferably the pressure pulse impacts at least one of a leading and a trailing edge of the aerofoil section. Preferably the method includes the steps of producing a pressure pulse which impacts a suction side of the leading or trailing edge and producing a pressure pulse which impacts a pressure side of the leading or trailing edge, the respective pressure pulses impacting substantially simultaneously.

The material may include an orifice, the inside surfaces of which are to be prestressed and the method may include the step of providing electrodes within the orifice. The method may further include the step of providing a tube of a non-conductive material within the orifice, the electrodes being contained within the tube.

According to the invention there is further provided apparatus for prestressing a material, the apparatus including a medium within which or adjacent to which the material may be located and means for providing an electrical discharge or current to produce a pressure pulse in the medium for impacting a surface of the material to provide a region of residual compressive stress within the material.

The composition of the medium may be such that a plasma may be generated by the electrical discharge or current. The medium preferably comprises a liquid such as water or oil.

Preferably the means for providing an electrical discharge or current is capable of providing a discharge or current having an energy of at least 35 J and a duration of less than 40 ns.

The means for providing an electrical discharge or current may include a pair of electrodes located at least 1 mm from the surface of the material. The electrodes may be located between the material and a fixed means for containing the pressure pulse.

The electrodes may be located remotely from the surface of the material and the apparatus may include means for directing the pressure pulse towards the surface of the material. The apparatus may include focusing means in the form of a reflector, the electrodes being located generally between the reflector and the surface of the material.

The apparatus may include concentrating means of a material through which the pressure pulse travels faster than it does in the medium, a sectional area of the concentrating means remote from the surface of the material being greater than a sectional area of the concentrating means adjacent the material.

The apparatus may include a conducting membrane for covering a surface of the material, and receiving the electrical discharge or current.

According to the invention there is further provided a material including a region of compressive residual stress produced by a method according to any of paragraphs five to fifteen above. The region of compressive stress may be provided in an area which is particularly subject to fatigue damage, foreign object damage, cavitation damage or erosion damage. The material may have been repaired prior to the production of the region of compressive stress.

The material may comprise part of an aerofoil section of a compressor or turbine blade or vane for a gas turbine engine. Preferably the region of compressive residual stress is provided within at least one of the leading and trailing edges of the aerofoil section. A region of residual compressive stress may be provided on both of a suction and pressure side of the leading or trailing edge of the aerofoil section.

The region of compressive residual stress may extend at least 1 mm into the material.

BRIEF DESCRIPTION OF THE DRAWINGS

An embodiment of the invention will now be described with reference to the accompanying drawings in which.

DETAILED DESCRIPTION OF THE INVENTION

Figure 1:
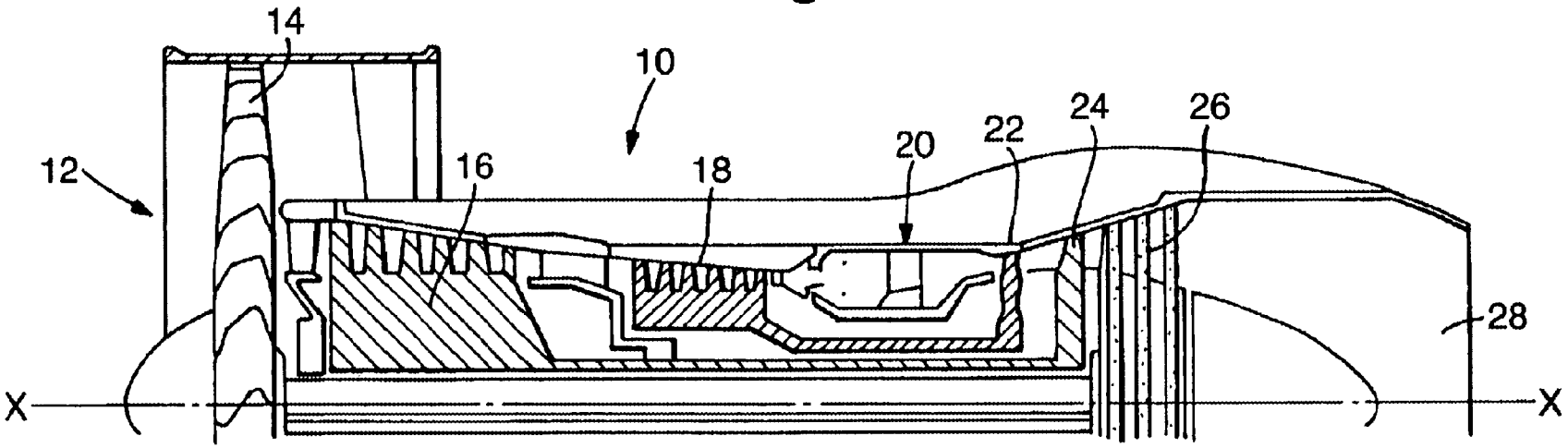
FIG. 1 is a diagrammatic sectional view of a ducted fan gas turbine engine.

With reference to FIG. 1, a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second air flow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 ad the fan 14 by suitable interconnecting shafts.

The aerofoil sections of the compressor and turbine blades and vanes are susceptible to damage as discussed previously. However, the likelihood of such damage occurring, or if it does occur leading to blade failure due to fatigue effects, may be minimised by surface treatment of the blades, for example by peening. This imparts to the surface region a residual compressive stress which reduces the effects of the tensile stresses applied to the surface by external loads.

According to one aspect of the invention, the aerofoil sections are treated by electric spark processing. Electric spark processing uses an electrical discharge or current to generate a shock wave which impacts the component to be treated. The shock wave induces residual compressive stresses within the component, thus producing the "peening" effect discussed above.

Figure 2:
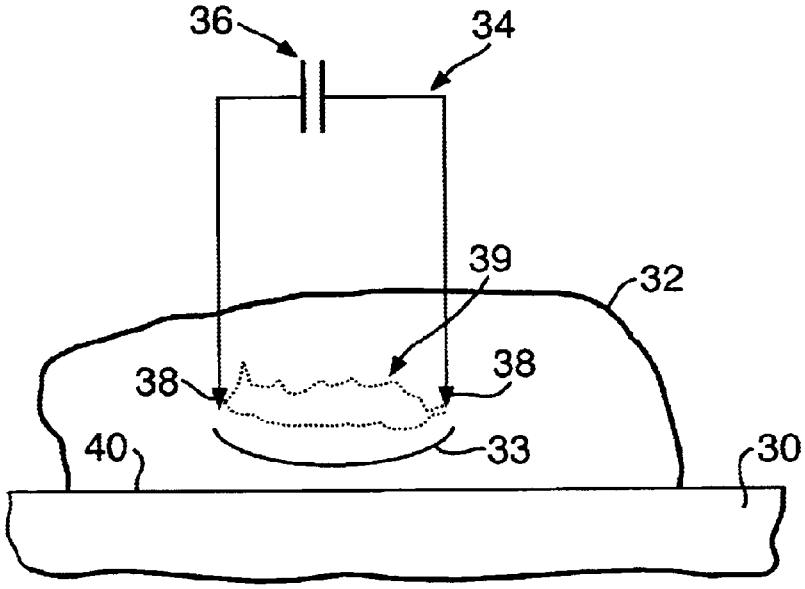
FIG. 2 is a diagrammatic sectional view indicating a first embodiment of the invention.

Referring to FIG. 2 a component 30 to be treated is placed in a fluid medium 32, such as water or oil. The component 30 may be an aerofoil section of a compressor or fan blade, for example. An electrical discharge circuit 34, which in this example includes a capacitor 36, includes a pair of electrodes 38 positioned about 5 to 10 mm apart within the medium 32.

The electrical discharge circuit 34 is able to generate a very rapid electrical discharge (for example, having an energy of over 40 J within a duration of under 30 ns). This causes a plasma 39 to be generated within the medium 32 leading to shock waves 33 which travel through the medium to the component 30. When the shock waves hit a surface 40 of the component 30, a compressive force of up to around 20 GPa is generated at the surface of the component, causing a significant compressive stress.

Figure 3:
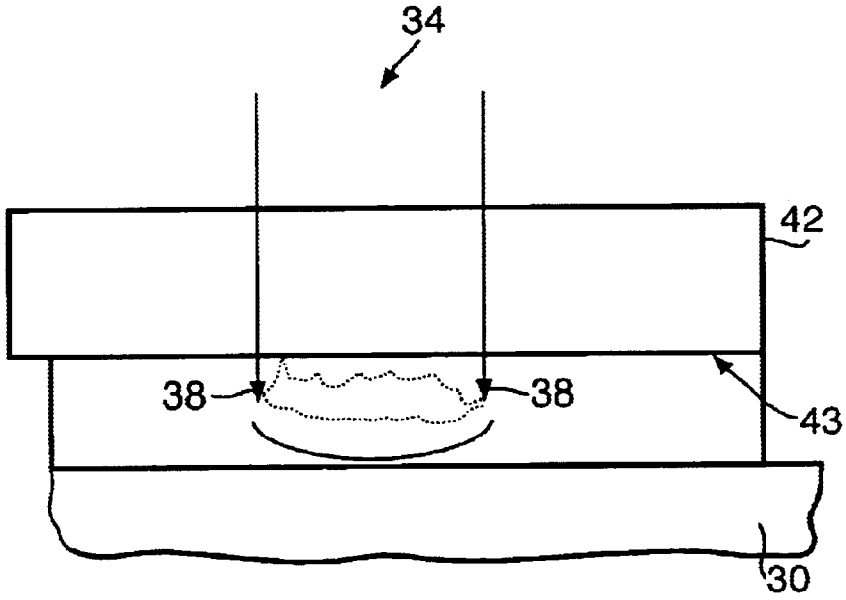
FIG. 3 is a diagrammatic sectional view indicating a second embodiment of the invention.

Referring to FIG. 3, the simple system of FIG. 2 may be modified in that the electrodes 38 may be provided between the component 30 and a restraining member 42. The restraining member 42 is fixed in place and includes an inner face 43 which forms a simple reflector for the shock waves. The restraining member 42 restricts movement of the medium 32 and hence increases the energy of the shock waves incident on the component 30.

Figure 4:
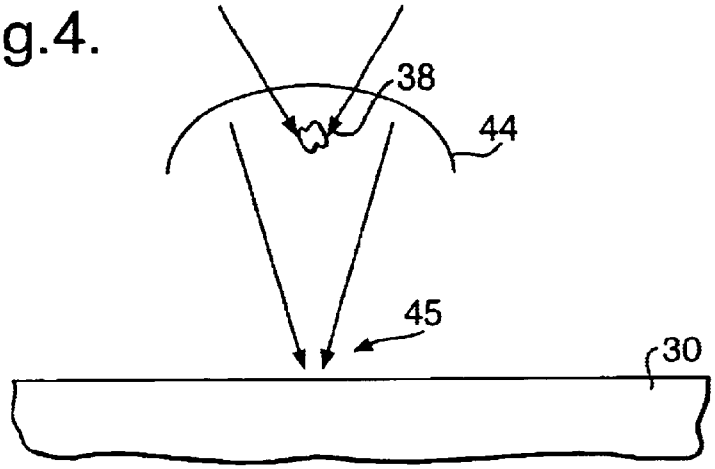
FIG. 4 is a diagrammatic sectional view indicating a third embodiment of the invention.

Referring to FIG. 4, in an alternative embodiment of the invention a concave reflector 44 is positioned such that the electrodes 38 are located between the reflector 44 and the component 30. The reflector 44 may be used to localise, spread or otherwise shape the shock waves. The shock waves may be shaped to give them a substantially uniform intensity to give a uniform peening action, or alternatively may be shaped to produce non-uniform pressures on the surface of the component to give characteristics which may be required for overlapping of application areas or for forming specific shapes. The example shown in FIG. 4 demonstrates a focusing application, the waves being focused towards an application paint 45.

Figure 5:
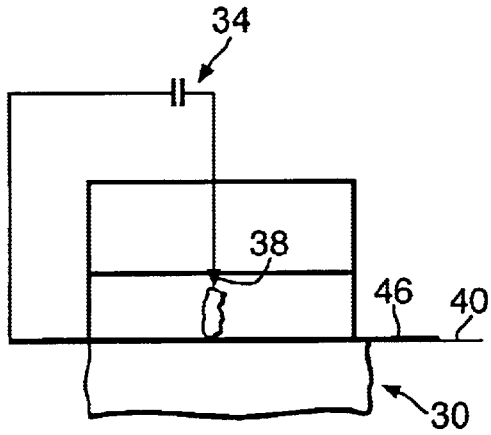
FIG. 5 is a diagrammatic sectional view indicating a fourth embodiment of the invention.

Referring to FIG. 5, in an alternative embodiment of the invention, a conducting membrane 46 is placed in close or intimate contact with the surface 40 of the component 30 to be treated. Alternatively a conductive coating could be applied to the surface, although this would need to be removed after processing. The coating could consist of a sacrificial layer of the parent material, which could be machined off or otherwise removed after processing. The electrical discharge in this embodiment takes place between the membrane 46 and an electrode 38 located close to the conducting membrane 46. This allows the electrical discharge to be close to the surface 40 without causing damage to it by direct spark impact. Any damage occurs to the conducting membrane 46, which may be replaced. This method also allows more complex shapes to be processed without the need to very accurately control the gap between the electrodes and the surface in order to prevent discharge onto the surface. The technique could also be used inside cavities and holes.

Figure 6:
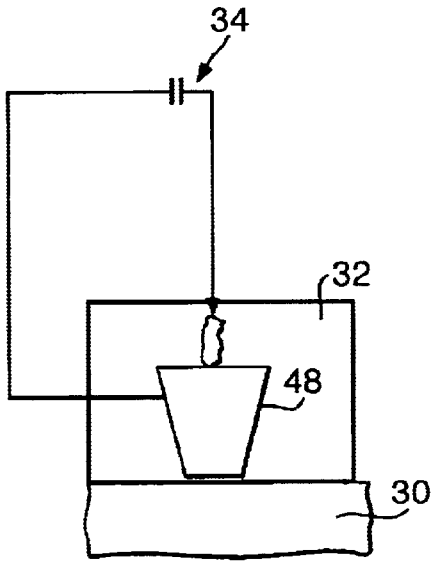
FIG. 6 is a diagrammatic sectional view indicating a fifth embodiment of the invention.

Referring to FIG. 6, an alternative embodiment of the invention includes a focusing means in the form of a solid member 48. The solid member 48 is located near to the component and in this embodiment is of a generally frusto conical shape. A sectional area of the solid member 48 near to the component 30 is smaller than a sectional area of the solid member 48 remote from the component 30. Shock waves travel faster within the solid member 48 than within the medium 32 and are focused by the reducing sectional area of the solid member as the shock waves approach the component 30. This increases the intensity of the shock wave as it impacts the component. Again, any spark damage occurs to the member 48, rather than the component 30.

Figure 7:
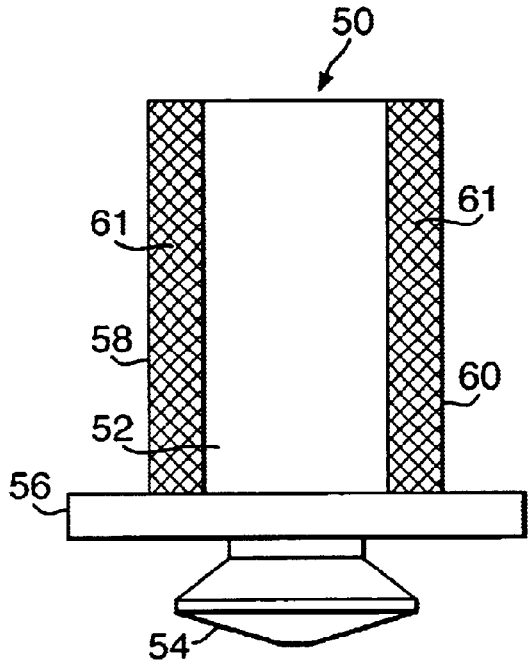
FIG. 7 is a diagrammatic sectional view indicating a sixth embodiment of the invention.

The component may be an aerofoil section of, for example, a compressor blade. Referring to FIG. 7, a compressor blade 50 comprises an aerofoil section 52, a root portion 54 and a platform 56 connecting the root portion 54 of the blade 50 to the aerofoil section 52. The aerofoil section includes a leading edge 58 and a trailing edge 60.

The leading and trailing edges 58 and 60 respectively of the aerofoil section 52 are treated using electric spark processing as previously described. The blade includes a pressure side (facing out of the page in FIG. 7) and a suction side (facing into the page in FIG. 7). In a preferred method according to the invention, electric spark processing is used to provide a simultaneous peening of both the pressure side and the suction side of the leading or trailing edge 58 or 60. This produces residual compressive stresses within the shaded areas 61 of FIG. 7. By processing both sides simultaneously, distortion of the blade is minimised. Progressive alternating treatment of either side could produce a similar effect.

Figure 8:
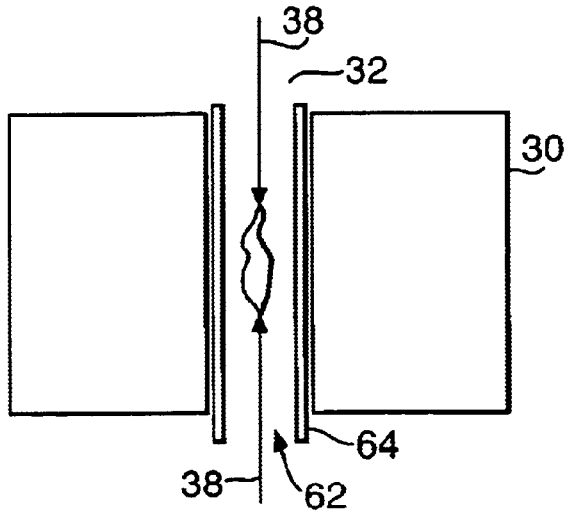
FIG. 8 is an illustration of an alternative embodiment of the invention.

Referring to FIG. 8, an alternative component 30 includes an orifice 62, the inside walls of which are to be peened by electric spark processing. A tube or sleeve 64 is provided within the orifice 62 and electrodes 38 are provided within the tube 64. The tube 64 insulates the surfaces from the component from sparks, but allows the ultrasonic shock pulse to travel therethrough.

There is thus provided a method for prestressing or peening the surfaces of components, which allows for penetrations of up to 1 mm or more and associated induced compressive stresses of up to 500 to 600 MPa at the surface of the component. Deep compressive residual stresses may be provided in the edges of aerofoil sections. The stresses may be provided in a strip along the leading and trailing edges extending across the blade for up to about 20% of the chord width on both the pressure and suction sides of the blade. The regions of compressive stress tend to extend further into the components than is the case where conventional shot peening methods are used. This may be partly because the stresses induced by shot peening tend to the "three dimensional" extending outwardly from the small impact point of each shot. In contrast, in the method according to the invention, a shock wave hits the whole of an area of the surface of the component, providing a "two dimensional" pressure. The effect of this is to provide residual stresses deeper into the component.

Various modifications may be made to the above described embodiments without departing from the scope of the invention. The methods of producing the current, and of directing and focusing the shock wave, may be modified. Many such methods are known and available. The method may be used to treat any component where prestressing is desirable, for example where shot peening is currently used. Such components may include, for example, the leading edges of propellers and impellers for ships, and parts of turbomachinery including pumps, turbo and superchargers and ship and boat propellers and impellors.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A method of prestressing a material, the method including the step of using an electrical discharge or current to produce a pressure pulse in a medium adjacent the material without the electrical discharge directly contacting the material, the pressure pulse impacting a surface of the material to produce a region of compressive residual stress within the material.

2. A method according to claim 1 wherein the electrical discharge or current generates a plasma in the medium.

3. A method according to claim 1 wherein the pressure pulse produces an impact pressure of at least 15 GPa on the surface of the material.

4. A method according to claim 1 wherein the electrical discharge or current is provided between electrodes.

5. A method according to claim 1 wherein the discharge takes place between the material and a fixed means for containing the pressure pulse.

6. A method according to claim 1 wherein the discharge takes place remotely from the surface of the material and the method includes the step of directing the pressure pulse towards the surface of the material.

7. A method according to claim 6, the method including the step of providing focusing means in the form of a reflector.

8. A method according to claim 1, the method including the step of concentrating the pressure pulse as it approaches the surface of the material.

9. A method according to claim 8, the method including the step of providing concentrating means of a material through which the pressure pulse travels faster than it does in the medium, a sectional area of the concentrating means remote from the surface of the material being greater than a sectional area of the concentrating means adjacent the material.

10. A method according to claim 1 further including the step of providing a sacrificial layer on the material and the step of removing said damaged, sacrificial layer from the surface of the material after prestressing.

11. A method according to claim 1, the method including the step of providing a conducting membrane over a surface of the material and providing the electrical discharge or the current through the conducting membrane.

12. A method according to claim 1 wherein the material comprises part of an aerofoil section, which may form part of a compressor or turbine blade or vane.

13. A method according to claim 12 wherein the pressure pulse impacts at least one of a leading and a trailing edge of the aerofoil section.

14. A method according to claim 13 wherein the method includes the steps of producing a pressure pulse which impacts a suction side of the leading or trailing edge and producing a pressure pulse which impacts a pressure side of the leading or trailing edge, the respective pressure pulses impacting substantially simultaneously.

15. A method according to claim 1 wherein the material includes an orifice, the inside surfaces of which are to be prestressed, and the method includes the step of providing electrodes within the orifice.

16. A method according to claim 15, the method further including the step of providing a tube of a non-conductive material within the orifice, the electrodes being contained within the tube.

17. A material including a region of compressive residual stress produced by a method according to claim 1.

18. A material according to claim 17 wherein the region of compressive stress is provided in an area which is particularly subject to fatigue damage, foreign object damage, cavitation damage or erosion damage.

19. A material according to claim 17 wherein the material has been repaired prior to the production of the region of compressive stress.

20. A material according to claim 17, the material comprising an aerofoil section of a compressor or turbine blade or vane for a gas turbine engine.

21. A material according to claim 20 wherein the region of compressive residual stress is provided within at least one of the leading and trailing edges of the aerofoil section.

22. A material according to claim 21 wherein a region of residual compressive stress is provided on both of a suction and pressure side of the leading or trailing edge of the aerofoil section.

23. A material according to claim 17 wherein the region of compressive residual stress extends at least 1 mm into the material.

24. A method of prestressing a material, the method including the step of using an electrical discharge or current to produce a pressure pulse in one of the material and a medium adjacent the material, the pressure pulse impacting a surface of the material to produce a region of compressive residual stress within the material, wherein the electrical discharge or current has an energy of at least 35 J and a duration of less than 40 ns.

* * * * *